US011738390B2

(12) United States Patent
Kuniyoshi et al.

(10) Patent No.: US 11,738,390 B2
(45) **Date of Patent: *Aug. 29, 2023**

(54) METHOD OF PRODUCING R-T-B SINTERED MAGNET

(71) Applicant: PROTERIAL, LTD., Tokyo (JP)

(72) Inventors: Futoshi Kuniyoshi, Minato-ku (JP); Shuji Mino, Minato-ku (JP)

(73) Assignee: PROTERIAL, LTD., Tokyo (JP)

( * ) Notice: Subject to any disclaimer, the term of this patent is extended or adjusted under 35 U.S.C. 154(b) by 431 days.

This patent is subject to a terminal disclaimer.

(21) Appl. No.: 16/336,130

(22) PCT Filed: Sep. 26, 2017

(86) PCT No.: PCT/JP2017/034730

§ 371 (c)(1),
(2) Date: Mar. 25, 2019

(87) PCT Pub. No.: WO2018/062174

PCT Pub. Date: Apr. 5, 2018

(65) Prior Publication Data

US 2019/0214191 A1 Jul. 11, 2019

(30) Foreign Application Priority Data

Sep. 29, 2016 (JP) ..... 2016-190669

(51) Int. Cl.
*B22F 3/00* (2021.01)
*H01F 41/02* (2006.01)
(Continued)

(52) U.S. Cl.
CPC ..... *B22F 3/00* (2013.01); *B22F 1/00* (2013.01); *B22F 1/05* (2022.01); *B22F 3/24* (2013.01);
(Continued)

(58) Field of Classification Search
CPC ..... H01F 41/0253; H01F 1/057; H01F 41/02; H01F 1/0577; H01F 41/0293; B22F 3/00;
(Continued)

(56) References Cited

U.S. PATENT DOCUMENTS 5,682,670 A * 11/1997 Bell ..... H01F 41/16 310/156.43
2008/0053273 A1* 3/2008 Enokido ..... H01F 41/0273 75/246
(Continued)

FOREIGN PATENT DOCUMENTS

EP 1 970 924 A1 9/2008
JP 2012-234971 A 11/2012
(Continued)

OTHER PUBLICATIONS

Foroughi-Dahr et al., "Particle Coating in Fluidized Beds", University of Tehran, École Polytechnique de Montréal, Montréal, QC, Canada, 2017, pp. 1-17 (Year: 2017).*
(Continued)

*Primary Examiner* — Keith Walker
*Assistant Examiner* — Adil A. Siddiqui
(74) *Attorney, Agent, or Firm* — KEATING & BENNETT, LLP

(57) ABSTRACT

An application step of applying an adhesive agent to an application area of a surface of a sintered R-T-B based magnet work, an adhesion step of allowing a particle size-adjusted powder that is composed of a powder of an alloy or a compound of a Pr—Ga alloy which is at least one of Dy and Tb to the application area of the surface of the sintered R-T-B based magnet work, and a diffusing step of heating it at a temperature which is equal to or lower than a sintering temperature of the sintered R-T-B based magnet work to allow the Pr—Ga alloy contained in the particle size-
(Continued)

adjusted powder to diffuse from the surface into the interior of the sintered R-T-B based magnet work are included. The particle size of the particle size-adjusted powder is set so that, when powder particles composing the particle size-adjusted powder are placed on the entire surface of the sintered R-T-B based magnet work to form a particle layer which is not less than one layer and not more than three layers, the amount of Ga contained in the particle size-adjusted powder is in a range from 0.10 to 1.0% with respect to the sintered R-T-B based magnet work by mass ratio.

11 Claims, 4 Drawing Sheets

(51) Int. Cl.

| | |
|---|---|
| ***H01F 1/057*** | (2006.01) |
| ***B22F 7/02*** | (2006.01) |
| ***B22F 3/24*** | (2006.01) |
| ***C22C 30/00*** | (2006.01) |
| ***B22F 1/00*** | (2022.01) |
| ***C21D 6/00*** | (2006.01) |
| ***C22C 38/00*** | (2006.01) |
| ***C22C 28/00*** | (2006.01) |
| ***B22F 1/05*** | (2022.01) |

(52) U.S. Cl.
CPC ..... *B22F 7/02* (2013.01); *C21D 6/00* (2013.01); *C22C 28/00* (2013.01); *C22C 30/00* (2013.01); *C22C 38/00* (2013.01); *H01F 1/057* (2013.01); *H01F 1/0577* (2013.01); *H01F 41/02* (2013.01); *H01F 41/0253* (2013.01); *B22F 2003/248* (2013.01); *B22F 2201/10* (2013.01); *B22F 2201/20* (2013.01); *B22F 2301/355* (2013.01); *B22F 2301/45* (2013.01); *B22F 2304/10* (2013.01); *B22F 2998/10* (2013.01)

(58) Field of Classification Search
CPC ..... B22F 1/00; B22F 7/02; B22F 3/24; B22F 1/0011; B22F 2304/10; B22F 2201/20; B22F 2201/10; B22F 2301/45; B22F 2998/10; B22F 2301/355; B22F 2003/248; C22C 30/00; C22C 38/00; C22C 28/00; C21D 6/00; C23C 10/30
USPC ..... 427/185
See application file for complete search history.

(56) References Cited

U.S. PATENT DOCUMENTS

| | | | | |
|---|---|---|---|---|
| 2008/0245442 | A1 | 10/2008 | Nakamura et al. | |
| 2014/0290803 | A1* | 10/2014 | Kato | H01F 1/0577 148/302 |
| 2017/0062127 | A1* | 3/2017 | Yi | B22F 3/24 |
| 2017/0221630 | A1* | 8/2017 | Haga | H01F 1/0577 |
| 2018/0025819 | A1 | 1/2018 | Shigemoto et al. | |

FOREIGN PATENT DOCUMENTS

| | | | |
|---|---|---|---|
| WO | 2006/043348 | A1 | 4/2006 |
| WO | 2016/133071 | A1 | 8/2016 |

OTHER PUBLICATIONS

Bralla et al., "Handbook of Manufacturing Processes—How Products, Components and Materials are Made—8.A1d Tumbling". Industrial Press, 2007, pp. 329-343 (Year: 2007).*

Official Communication issued in International Patent Application No. PCT/JP2017/034730, dated Jan. 9, 2018.

* cited by examiner

METHOD OF PRODUCING R-T-B SINTERED MAGNET

TECHNICAL FIELD

The present disclosure relates to a method for producing a sintered R-T-B based magnet (where R is a rare-earth element; and T is Fe, or Fe and Co).

BACKGROUND ART

Sintered R-T-B based magnets whose main phase is an $R_2T_{14}B$-type compound are known as permanent magnets with the highest performance, and are used in voice coil motors (VCM) of hard disk drives, various types of motors such as motors for electric vehicles (EV, HV, PHV, etc.) and motors for industrial equipment, home appliance products, and the like.

A sintered R-T-B based magnet is composed of a main phase which mainly consists of an $R_2T_{14}B$ compound and a grain boundary phase that is at the grain boundaries of the main phase. The main phase, i.e., an $R_2T_{14}B$ compound, has a high saturation magnetization and anisotropy field, and provides a basis for the properties of a sintered R-T-B based magnet.

Coercivity $H_{cJ}$ (which hereinafter may be simply referred to as "$H_{cJ}$") of sintered R-T-B based magnets decreases at high temperatures, thus causing an irreversible thermal demagnetization. For this reason, sintered R-T-B based magnets for use in motors for electric vehicles, in particular, are required to have high $H_{cJ}$.

It is known that $H_{cJ}$ is improved if a light rare-earth element RL (e.g., Nd or Pr) contained in the R of the $R_2T_{14}B$ compound of a sintered R-T-B based magnet is partially replaced with a heavy rare-earth element RH (e.g., Dy or Tb). $H_{cJ}$ is more improved as the amount of substituted RH increases.

However, replacing the RL in the $R_2T_{14}B$ compound with an RH may improve the $H_{cJ}$ of the sintered R-T-B based magnet, but decrease its remanence $B_r$ (which hereinafter may be simply referred to as "$B_r$"). Moreover, RHs, in particular Tb, Dy and the like, are scarce resource, and they yield only in limited regions. For this and other reasons, they have problems of instable supply, significantly fluctuating prices, and so on. Therefore, in the recent years, it has been desired to improve $H_{cJ}$ while using as little RH as possible.

On the other hand, it has been attempted to improve $H_{cJ}$ of a sintered R-T-B based magnet with less of a heavy rare-earth element RH, this being in order not to lower $B_r$. For example, one proposal involves: allowing a fluoride or an oxide of a heavy rare-earth element RH, or any of various metals M or M alloys, to be present on the surface of a sintered magnet, either alone by itself or in a mixture; performing a heat treatment in this state; and diffusing within the magnet a heavy rare-earth element RH that will contribute to an improved $H_{cJ}$. For example, Patent Document discloses allowing an R oxide, an R fluoride, or an R oxyfluoride in powder form to be in contact with the surface of a sintered R-T-B based magnet and performing a heat treatment, thus allowing them to diffuse into the magnet.

CITATION LIST

[Patent Document 1] International Publication No. 2006/043348

[Patent Document 2] International Publication No. 2016/133071

SUMMARY OF INVENTION

Technical Problem

Patent Document 1 discloses a method which allows a powder mixture containing a powder of an RH compound to be present on the entire magnet surface (the entire surface of the magnet) and performs a heat treatment. According to specific examples of this method, a magnet is immersed into a slurry which is obtained by dispersing the aforementioned powder in water or an organic solvent, and then retrieved (immersion/lifting technique). In the immersion/lifting technique, hot air drying or natural drying is performed for the magnet that has been retrieved out of the slurry. Instead of immersing the magnet into a slurry, spraying a slurry onto a magnet is also disclosed (spray coating technique).

These methods make it possible to apply a slurry on the entire surface of the magnet. Therefore, a heavy rare-earth element RH can be introduced into the magnet through the entire surface of the magnet, thereby providing a greater $H_{cJ}$ improvement after the heat treatment. However, in an immersion/lifting technique, the slurry will inevitably abound below the magnet, owing to gravity. On the other hand, the spray coating technique will result in a large coating thickness at the magnet end, owing to surface tension. Both methods have difficulty in allowing the RH compound to be uniformly present on the magnet surface. This leads to a problem in that the $H_{cJ}$ after heat treatment will considerably fluctuate.

When the coating layer is made thin by using a slurry of low viscosity, nonuniformity in the thickness of the coating layer can be somewhat improved. However, since the applied amount of slurry becomes reduced, the $H_{cJ}$ after the heat treatment cannot be greatly improved. When a plurality of applications are made in order to increase the applied amount of slurry, the production efficiency will be much lowered. In particular, when a spray coating technique is adopted, the slurry will also be applied on the inner wall surface of the spraying apparatus, thus deteriorating the efficiency of use of the slurry. This induces a problem in that the heavy rare-earth element RH, which is a scarce resource, is wasted.

Furthermore, as a method of improving $H_{cJ}$ without using RH, Patent Document 2 discloses a method which allows a powder of a Pr—Ga alloy to be in contact with on the surface of a sintered R-T-B based magnet, and performs a heat treatment to diffuse them into the magnet. According to this method, $H_{cJ}$ of a sintered R-T-B based magnet can be improved without using an RH. However, there are hardly any well-established methods for allowing these powders to be uniformly present on the surface of a sintered R-T-B based magnet.

The present disclosure provides a novel method in which, when forming a layer of powder particles containing a Pr—Ga alloy on a magnet surface in order to improve $H_{cJ}$ by diffusing an element(s) in the Pr—Ga alloy into a sintered R-T-B based magnet, such powder particles can be uniformly applied on the surface of the sintered R-T-B based magnet efficiently without waste, thus diffusing the Pr—Ga alloy into the interior from the magnet surface, thereby greatly improving $H_{cJ}$.

Solution to Problem

In an embodiment, a method for producing a sintered R-T-B based magnet according to the present disclosure comprises: a step of providing a sintered R-T-B based magnet work (where R is a rare-earth element; and T is Fe, or Fe and Co); a step of providing a particle size-adjusted powder that is composed of a powder of a Pr—Ga (Pr accounts for 65 to 97 mass % of the entire Pr—Ga alloy; 20 mass % or less of Pr is replaceable with Nd; 30 mass % or less of Pr is replaceable with Dy and/or Tb. Ga accounts for 3 mass % to 35 mass % of the entire Pr—Ga alloy; and 50 mass % or less of Ga is replaceable with Cu. Inevitable impurities may be contained) alloy; an application step of applying an adhesive agent to an application area of a surface of the sintered R-T-B based magnet work; an adhesion step of allowing the particle size-adjusted powder to adhere to the application area of the surface of the sintered R-T-B based magnet work having the adhesive agent applied thereto; and a heat treatment step of heating the sintered R-T-B based magnet work having the particle size-adjusted powder adhering thereto at a temperature which is equal to or lower than a sintering temperature of the sintered R-T-B based magnet work, wherein, the adhesion step is a step of allowing the particle size-adjusted powder to adhere in not less than one layer and not more than three layers to the surface of the sintered R-T-B based magnet work, such that the amount of Ga contained in the particle size-adjusted powder adhering to the surface of the sintered R-T-B based magnet work is in a range from 0.10 to 1.0% with respect to the sintered R-T-B based magnet work by mass ratio.

In one embodiment, the sintered R-T-B based magnet work comprises R: 27.5 to 35.0 mass % (R is at least one rare-earth element which always includes Nd), B: 0.80 to 0.99 mass %, Ga: 0 to 0.8 mass %, M: 0 to 2 mass % (where M is at least one of Cu, Al, Nb, and Zr), and a balance T (where T is Fe, or Fe and Co) and inevitable impurities, the sintered R-T-B based magnet work having a composition satisfying the inequality: $[T]/55.85>14[B]/10.8$, where [T] represents a T content in mass %, and [B] represents a B content in mass %.

In one embodiment, an Nd content in the Pr—Ga alloy is equal to or less than an inevitable impurity content.

In one embodiment, the particle size-adjusted powder is a particle size-adjusted powder which has been granulated with a binder.

In one embodiment, the adhesion step is a step of allowing the particle size-adjusted powder to adhere to a plurality of regions of different normal directions within the surface of the sintered R-T-B based magnet work.

In one embodiment, the heat treatment step comprises: performing a first heat treatment at a temperature which is above 600° C. but not higher than 950° C., in a vacuum or an inert gas ambient; and a step of subjecting the sintered R-T-B based magnet work having undergone the first heat treatment to a second heat treatment at a temperature which is lower than the temperature used in the step of performing the first heat treatment and which is not lower than 450° C. and not higher than 750° C., in a vacuum or an inert gas ambient.

In an embodiment, a method for producing a sintered R-T-B based magnet according to the present disclosure comprises: a step of providing a sintered R-T-B based magnet work (where R is a rare-earth element; and T is Fe, or Fe and Co); a step of providing a diffusion source powder that is composed of a powder of a Pr—Ga (Pr accounts for 65 to 97 mass % of the entire Pr—Ga alloy; 20 mass % or less of Pr is replaceable with Nd; 30 mass % or less of Pr is replaceable with Dy and/or Tb. Ga accounts for 3 mass % to 35 mass % of the entire Pr—Ga alloy; and 50 mass % or less of Ga is replaceable with Cu. Inevitable impurities may be contained) alloy; an application step of applying an adhesive agent to an application area of a surface of the sintered R-T-B based magnet work; an adhesion step of allowing the diffusion source powder to adhere to the application area of the surface of the sintered R-T-B based magnet work having the adhesive agent applied thereto; and a diffusing step of heating the sintered R-T-B based magnet work having the diffusion source powder adhering thereto at a temperature which is equal to or lower than a sintering temperature of the sintered R-T-B based magnet work to allow the Ga contained in the diffusion source powder to diffuse from the surface into the interior of the sintered R-T-B based magnet work, wherein, in the adhesion step, the diffusion source powder adhering to the application area comprises: (1) a plurality of particles being in contact with a surface of the adhesive agent; (2) a plurality of particles adhering to the surface of the sintered R-T-B based magnet work via nothing but the adhesive agent; and (3) other particles sticking to one or more particles among the plurality of particles not via any adhesive material.

In one embodiment, in the adhesion step, the diffusion source powder is allowed to adhere to the application area so that the amount of Ga contained in the diffusion source powder is in a range from 0.1 to 1.0% with respect to the sintered R-T-B based magnet work by mass ratio.

In one embodiment, the thickness of the adhesive layer is not less than 10 μm and not more than 100 μm.

Advantageous Effects of Invention

According to an embodiment of the present disclosure, a layer of powder particles containing a Pr—Ga alloy can be uniformly applied on the surface of a sintered R-T-B based magnet work, efficiently without waste, in order to improve $H_{cJ}$ by diffusing an element(s) in the Pr—Ga alloy into a sintered R-T-B based magnet work. It also becomes possible to improve $H_{cJ}$ of the sintered R-T-B based magnet while minimizing the amount of an heavy rare-earth element RH (which is a scarce resource) to be used.

DESCRIPTION OF EMBODIMENTS

An illustrative embodiment of a method for producing a sintered R-T-B based magnet according to the present disclosure includes:

1. a step of providing a sintered R-T-B based magnet work (where R is a rare-earth element; and T is Fe, or Fe and Co);
2. a step of providing a diffusion source powder (which may hereinafter be referred to as a "particle size-adjusted powder") that is composed of a Pr—Ga (Pr accounts for 65 to 97 mass % of the entire Pr—Ga alloy; 20 mass % or less of Pr is replaceable with Nd; 30 mass % or less of Pr is replaceable with Dy and/or Tb. Ga accounts for 3 mass % to 35 mass % of the entire Pr—Ga alloy; and 50 mass % or less of Ga is replaceable with Cu. Inevitable impurities may be contained) powder;
3. an application step of applying an adhesive agent to an application area (which does not need to be the entire magnet surface) of the surface of the sintered R-T-B based magnet work;
4. an adhesion step of allowing the particle size-adjusted powder to adhere to an application area of the surface of the sintered R-T-B based magnet work having the adhesive agent applied thereto; and
5. a diffusing step of heating the sintered R-T-B based magnet work having the particle size-adjusted powder adhering thereto at a temperature which is equal to or lower than the sintering temperature of the sintered R-T-B based magnet work, thereby allowing the Pr—Ga alloy contained in the particle size-adjusted powder to diffuse from the surface into the interior of the sintered R-T-B based magnet work.

Moreover, the adhesion step is a step of allowing the particle size-adjusted powder to adhere in not less than one layer and not more than three layers to the surface of the sintered R-T-B based magnet work, such that the amount of Ga contained in the particle size-adjusted powder adhering to the surface of the sintered R-T-B based magnet work is in a range from 0.10 to 1.0% with respect to the sintered R-T-B based magnet work by mass ratio.

Figure 1A:
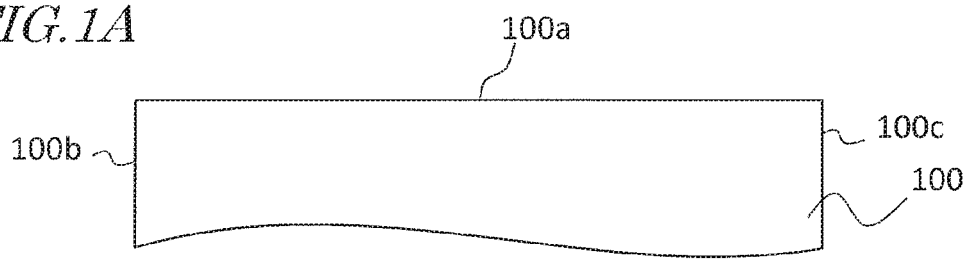
FIG. 1A A cross-sectional view schematically showing a part of a sintered R-T-B based magnet work 100 that was provided.

FIG. 1A is a cross-sectional view schematically showing a part of a sintered R-T-B based magnet work 100 that may be used in a method for producing a sintered R-T-B based magnet work according to the present disclosure. In the figure, an upper face 100*a* and side faces 100*b* and 100*c* of the sintered R-T-B based magnet work 100 are shown. The shape and size of the sintered R-T-B based magnet work used in the production method according to the present disclosure are not limited to the shape and size of the sintered R-T-B based magnet work 100 as illustrated. Although the upper face 100*a* and side faces 100*b* and 100*c* of the illustrated sintered R-T-B based magnet work 100 are flat, the surface of the sintered R-T-B based magnet work 100 may have rises and falls or stepped portions, or be curved.

Figure 1B:
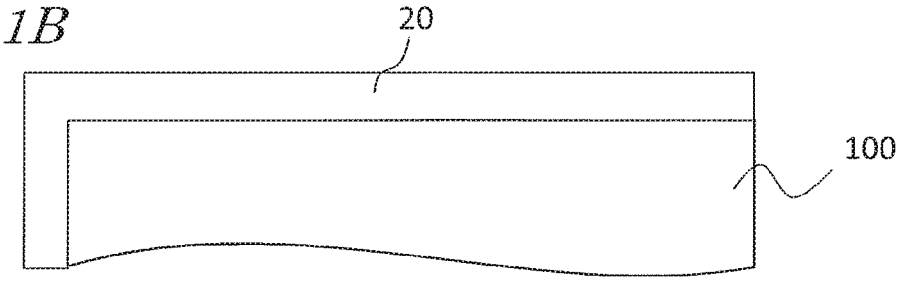
FIG. 1B A cross-sectional view schematically showing a part of a sintered R-T-B based magnet work 100 having an adhesive layer 20 formed in a portion of the magnet surface.

FIG. 1B is a cross-sectional view schematically showing a part of the sintered R-T-B based magnet work 100 having an adhesive layer 20 formed in a portion (an area for application) of the surface of the sintered R-T-B based magnet work 100. The adhesive layer 20 may be formed across the entire surface of the sintered R-T-B based magnet work 100.

Figure 1C:
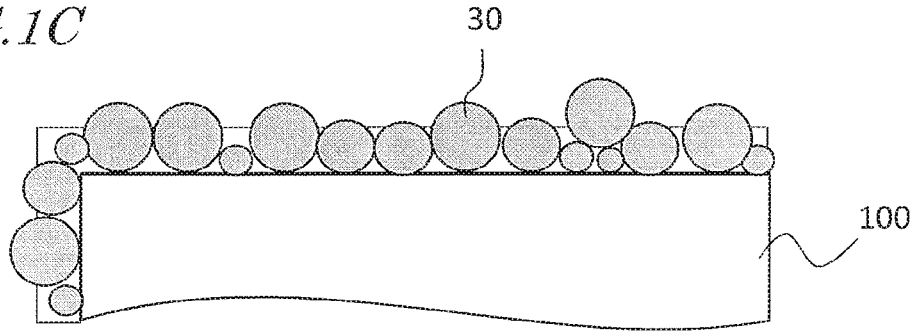
FIG. 1C A cross-sectional view schematically showing a part of a sintered R-T-B based magnet work 100 having a particle size-adjusted powder adhering thereto.

FIG. 1C is a cross-sectional view schematically showing a part of the sintered R-T-B based magnet work 100 having a particle size-adjusted powder adhering thereto. The powder particles 30 composing the particle size-adjusted powder that are located on the surface of the sintered R-T-B based magnet work 100 are allowed to adhere in a manner of covering the application area, thus constituting a layer of particle size-adjusted powder. The method for producing a sintered R-T-B based magnet work according to the present disclosure allows the particle size-adjusted powder to easily adhere through a single application step, without even changing the orientation of the sintered R-T-B based magnet work 100, in a plurality of regions of the surface of the sintered R-T-B based magnet work 100 that have differing normal directions (e.g., an upper face 100*a* and a side face 100*b*). It is also easy for the particle size-adjusted powder to uniformly adhere to the entire surface of the sintered R-T-B based magnet 100.

In the example shown in FIG. 1C, the particle size-adjusted powder adhering to the surface of the sintered R-T-B based magnet work 100 has a layer thickness which is approximately the particle size of powder particles composing the particle size-adjusted powder. When the sintered R-T-B based magnet work 100 having the particle size-adjusted powder adhering thereto as such is subjected to a diffusion heat treatment, the Pr—Ga alloy contained in the particle size-adjusted powder can be diffused from the surface into the interior of the sintered R-T-B based magnet work, efficiently without waste.

According to an embodiment of the present disclosure, the particle size-adjusted powder (diffusion source powder) which has adhered to the application area in the adhesion step is composed of: (1) a plurality of particles being in contact with the surface of the adhesive layer 20; (2) a plurality of particles adhering to the surface of the sintered R-T-B based magnet work 100 via nothing but the adhesive layer 20; and (3) other particles sticking to one or more particles among the plurality of particles not via any adhesive material. Note that not all of (1) to (3) above are required; rather, the particle size-adjusted powder adhering to the application area may be composed of (1) and (2) alone, or (2) alone.

The region that is composed of the aforementioned (1) to (3) of the particle size-adjusted powder does not need to account for the entire application area; rather, 80% or more of the entire application area may be composed of (1) to (3) above. In order to allow the particle size-adjusted powder sintered R-T-B based magnet work to adhere more uniformly, the application area in which the particle size-adjusted powder is composed of (1) to (3) above preferably accounts for 90% or more of the entire application area, and, most preferably, the entire application area is composed of (1) to (3) above.

Figure 1D:
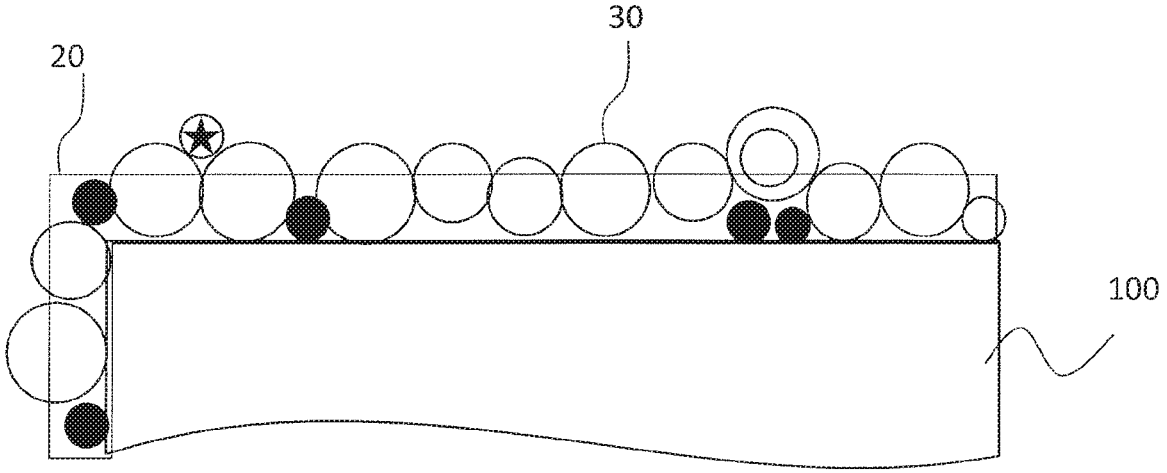
FIG. 1D An explanatory diagram exemplifying constitutions (1) to (3) according to the present invention.

FIG. 1D is an explanatory diagram exemplifying the constitutions of (1) to (3) above according to the present invention. In FIG. 1D, (1) the powder particles being in contact with the surface of the adhesive layer 20 are depicted as "double circle" powder particles (corresponding to the constitution of (1) alone); (2) the powder particles adhering to the surface of the sintered R-T-B based magnet work 100 via nothing but the adhesive layer 20 are depicted as "dark circle" powder particles; (3) other particles sticking to one or more particles among the plurality of particles not via any adhesive material are depicted as "starred circle" powder particles; and powder particles corresponding to both (1) and (2) are depicted as "blank circle" powder particles. Note that (1) is satisfied if some of the powder particles 30 are in contact with the surface of the adhesive layer 20; (2) is satisfied if no other powder particles or the like, besides the adhesive agent, are present between the powder particles 30 and the surface of the sintered R-T-B based magnet work; and (3) is satisfied if the adhesive layer 20 is not in contact with the powder particles 30. As shown in FIG. 1D, by ensuring that the particle size-adjusted powder that was allowed to adhere to the application area in the adhesion step are composed of (1) to (3), approximately one layer (not less than one layer and not more than three layers) is allowed to adhere to the surface of the sintered R-T-B based magnet work.

Figure 1E:
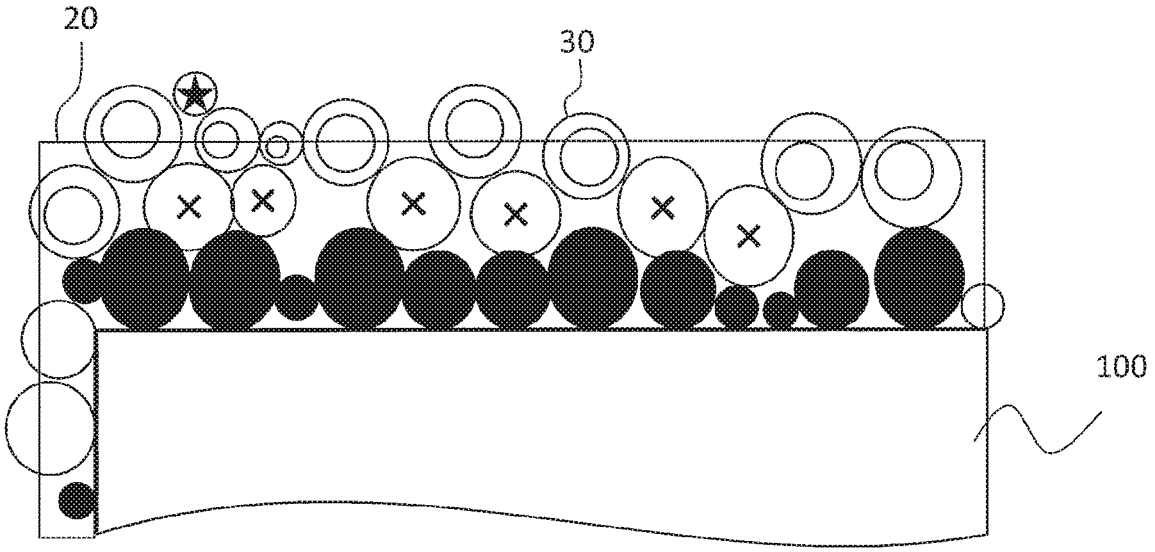
FIG. 1E An explanatory diagram exemplifying, as Comparative Example, a case where any constitution other than (1) to (3) is included.

On the other hand, FIG. 1E is an explanatory diagram exemplifying, as Comparative Example, a case where constitutions other than (1) to (3) above are included. Powder particles not corresponding to any of (1) to (3) are depicted as "X" powder particles. As shown in FIG. 1E, due to inclusion of constitutions other than (1) to (3), the particle size-adjusted powder is formed in a number of layers on the surface of the sintered R-T-B based magnet work.

According to an embodiment of the present disclosure, with good reproducibility, the same amount of powder is allowed to adhere to the magnet surface. That is, once the particle size-adjusted powder has adhered to the magnet surface in the states illustrated in FIG. 1C and FIG. 1D, the particles composing the particle size-adjusted powder hardly adhere to the application area, even if the particle size-adjusted powder keeps being supplied to the application area of the magnet surface. Therefore, it is easy to control the adhered amount of the particle size-adjusted powder, and hence the diffused amount(s) of the element(s).

According to an embodiment of the present disclosure, the thickness of the adhesive layer 20 is not less than 10 μm and not more than 100 μm.

One important aspect of the method for producing a sintered R-T-B based magnet according to the present disclosure is in controlling the particle size of the particle size-adjusted powder in order to control a mass ratio of the Ga to be diffused into the sintered R-T-B based magnet work to the sintered R-T-B based magnet work (which hereinafter will be simply referred to as "Ga amount"). This particle size is set so that, when powder particles composing the particle size-adjusted powder are placed on the entire surface of the sintered R-T-B based magnet work to form not less than one layer and not more than three layers of particle layers, the amount of Ga contained in the particle size-adjusted powder on the magnet surface is in a range from 0.1 to 1.0% by mass ratio with respect to the sintered R-T-B based magnet. As used herein, "a single particle layer" is based on the assumption that one layer is allowed to adhere to the surface of the sintered R-T-B based magnet work while leaving no spaces (i.e., adhering in a close-packed manner), where any minute spaces that may be present between powder particles and between each powder particle and the magnet surface are ignored.

Figure 2:
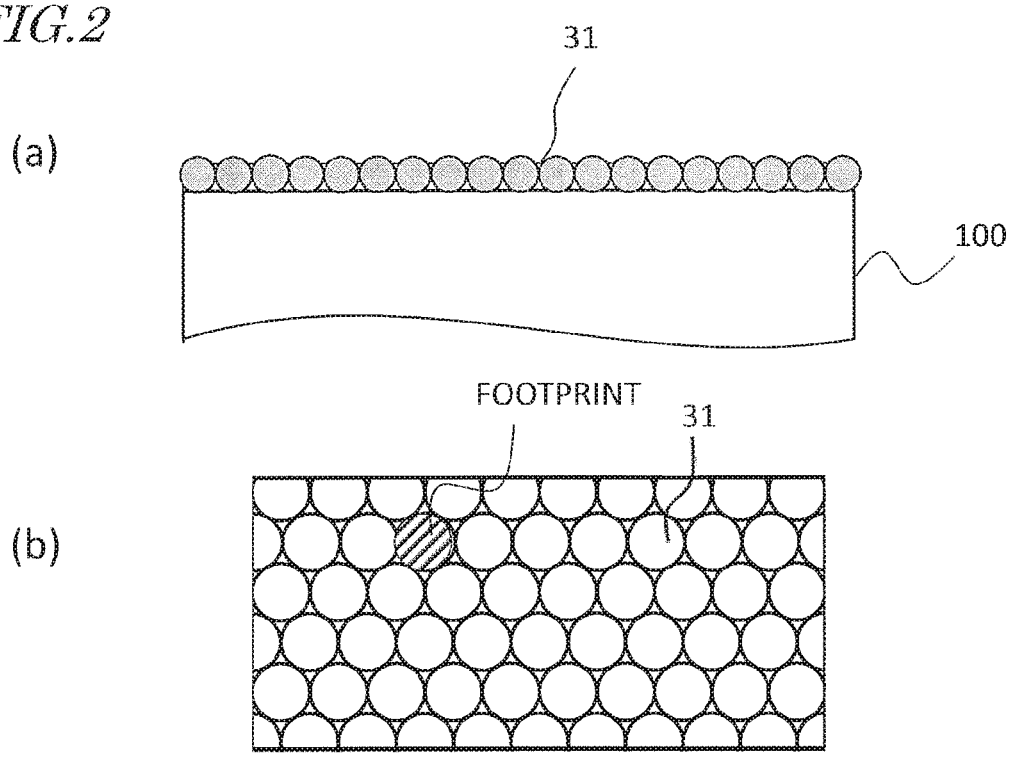
FIG. 2 (*a*) is a cross-sectional view schematically showing a part of the sintered R-T-B based magnet work 100 having a particle size-adjusted powder adhering thereto; and (*b*) is a diagram showing a partial surface of the sintered R-T-B based magnet work 100 having a particle size-adjusted powder adhering thereto, as viewed from above.
Figure 3:
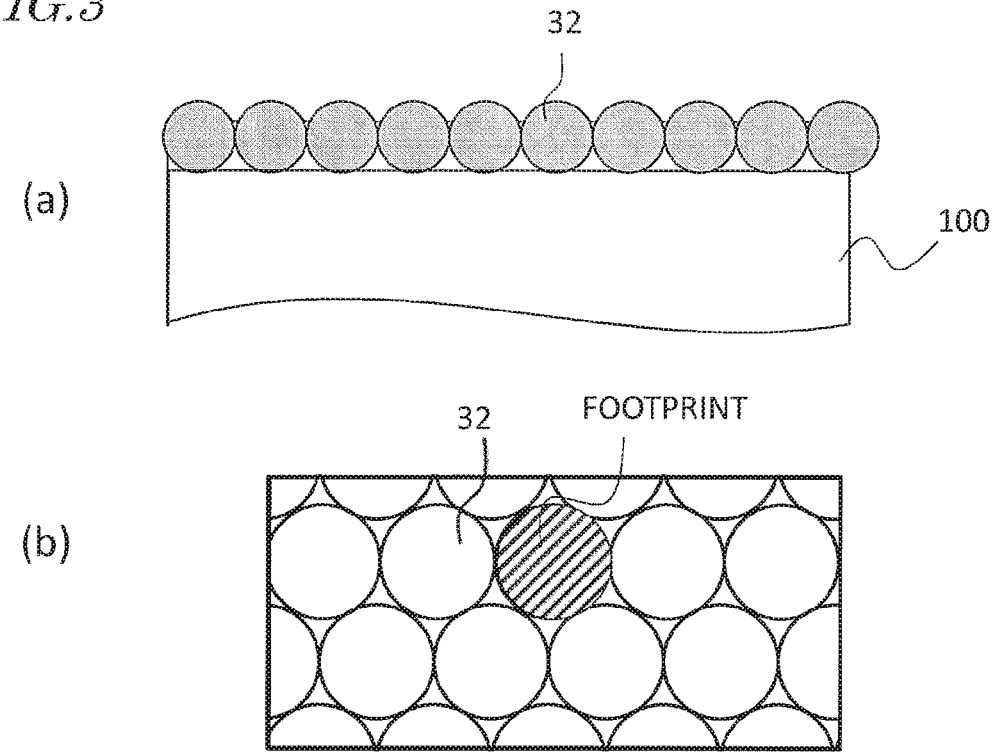
FIG. 3 (*a*) is a cross-sectional view schematically showing a part of the sintered R-T-B based magnet work 100 having a particle size-adjusted powder adhering thereto; and (*b*) is a diagram showing a partial surface of the sintered R-T-B based magnet work 100 having a particle size-adjusted powder adhering thereto, as viewed from above.

With reference to FIG. 2 and FIG. 3, it will be explained how the Ga amount can be controlled through a particle size control of the particle size-adjusted powder. FIG. 2(*a*) and FIG. 3(*a*) are both cross-sectional views schematically showing a part of the sintered R-T-B based magnet work 100 having the particle size-adjusted powder adhering thereto. Also, FIG. 2(*b*) and FIG. 3(*b*) are both diagrams showing a partial surface of the sintered R-T-B based magnet work 100 having the particle size-adjusted powder adhering thereto as viewed from above. The illustrated particle size-adjusted powder is composed of powder particles 31 with a relatively smaller particle size, or powder particles 32 with a relatively large particle size.

For simplification, it is assumed that the particle size of each powder adhering to the magnet surface is uniform. It is also assumed that the amount of Ga (Ga concentration) per unit volume of the powder particles 31 and that of the powder particles 32 are equal. It is assumed that the powder particles 31 and the powder particles 32 are allowed to adhere in one layer to the surface of the sintered R-T-B based magnet work while leaving no spaces (i.e., adhering in a close-packed manner), where any minute spaces that may be present between powder particles and between each powder particle and the magnet surface are ignored.

It is assumed that the powder particles 32 in FIG. 3 have a particle size which is exactly twice as large as the particle size of the powder particles 31 in FIG. 2. Accordingly, if one powder particle 31 has a footprint S on the surface of the sintered R-T-B based magnet work, then one powder particle 32 will have a footprint of $2^2S=4S$ on the surface of the sintered R-T-B based magnet work. Moreover, if the amount of Ga contained in the powder particles 31 is x, then the amount of Ga contained in the powder particles 32 is $2^3x=8x$. The number of powder particles 31 per unit area of the surface of the sintered R-T-B based magnet work is 1/S, and the number of powder particles 32 per unit area is ¼S. Therefore, the amount of Ga per unit area of the surface of the sintered R-T-B based magnet work is $x\times1/S=x/S$ for the powder particles 31, and $8x\times\frac{1}{4}S=2x/S$ for the powder particles 32. By allowing the powder particles 32 to adhere to the magnet surface in just one layer while leaving no spaces, the amount of Ga that is present on the surface of the sintered R-T-B based magnet work is doubled as compared to that of the powder particles 31.

In the above example, by increasing the particle size twofold, the amount of Ga that is present on the surface of the sintered R-T-B based magnet work can be increased twofold. As can be seen from this simplified example, by controlling the particle size of the particle size-adjusted powder, it is possible to control the amount of Ga that is present on the surface of the sintered R-T-B based magnet work.

The shape of the particles of an actual particle size-adjusted powder will not be completely spherical, and their particle size will also be varied. Furthermore, the layer(s) of particle size-adjusted powder to adhere to the surface of the sintered R-T-B based magnet work does not need to be exactly one layer. However, the fact still remains that the amount of Ga that is present on the surface of the sintered R-T-B based magnet work can be controlled by adjusting the particle size of the particle size-adjusted powder. As a result, through the diffusion heat treatment step, the amount of Ga to diffuse from the magnet surface to the magnet interior can be controlled to be within a desired range that is required for improved magnet characteristics, with a good yield.

The particle size (particle size specification) for ensuring that the amount of Ga contained in the particle size-adjusted powder on the magnet surface is in a range from 0.10 to 1.0% by mass ratio with respect to the sintered R-T-B based magnet work, when the powder particles composing the particle size-adjusted powder is placed on the entire surface of the sintered R-T-B based magnet work to form a particle layer(s), can be determined through experimentation and/or calculation. In order to determine this through experimentation, a relationship between the particle size of the particle size-adjusted powder and the Ga amount may be determined through experimentation, and from there, a particle size of the particle size-adjusted powder (e.g. 300 μm or less) that will result in the desired Ga amount may be determined. Moreover, as mentioned above, the particle size-adjusted powder adhering to the surface of the sintered R-T-B based magnet work 100 has a layer thickness which is approximately the particle size of powder particles composing the particle size-adjusted powder. In accordance with the composition of the particle size-adjusted powder, the ratio of an amount of Ga that is present on the magnet surface in the case where the particle size-adjusted powder is allowed to adhere in one layer, to that in the case of forming a layer with a thickness which is approximately equal to the particle size, can be determined through experimentation. Based on such experimental results, a particle size of the particle size-adjusted powder that will result in the desired Ga amount may then be determined through calculation. Thus, a particle size of the particle size-adjusted powder can be determined through a calculation that is based on data which is obtained through experimentation. Moreover, under simplified conditions as have been described with respect to the above examples of FIG. 2 and FIG. 3, a particle size may be determined through calculation alone, whereby the amount of Ga contained in the particle size-adjusted powder on the magnet surface can be set to a desired range.

Although the above description refers to the amount of Ga in the Pr—Ga alloy, the same is also true of the amount of Pr. In other words, by adjusting the particle size of the particle size-adjusted powder and the thickness of (i.e., number of layers in) the adhering layer, both the amount of Pr and the amount of Ga that are contained in the adhering layer on the magnet surface can be controlled. This makes it possible to control both the amount of Pr and the amount of Ga to be introduced into the sintered R-T-B based magnet work to an appropriate range. The amount of Pr in the Pr—Ga alloy is in a range from 0.5 to 9.5% with respect to the sintered R-T-B based magnet work by mass ratio, for example.

Note that the amounts of Pr and Ga contained in the particle size-adjusted powder depends not only on the particle size of the particle size-adjusted powder, but also on the composition of the Pr—Ga alloy in the particle size-adjusted powder. Therefore, it is possible to adjust the amounts of Pr and Ga contained in the particle size-adjusted powder by varying the composition of the Pr—Ga alloy in the particle size-adjusted powder, while keeping the particle size constant. However, as will be described later, there are bounds to the composition of the Pr—Ga alloy itself for efficiently attaining an improvement in $H_{cJ}$. Therefore, in the method according to the present disclosure, the amount of Ga contained in the particle size-adjusted powder is controlled by adjusting the particle size. Moreover, the amounts of Pr and Ga which are expected to be present on the magnet surface may vary depending on the size of the sintered R-T-B based magnet work; with the method according to the present disclosure, however, the amounts of Pr and Ga can still be controlled by adjusting the particle size of the particle size-adjusted powder.

With the particle size-adjusted powder whose particle size is thus adjusted, as will be described later, a $H_{cJ}$ improvement can be most efficiently attained. Moreover, $H_{cJ}$ improvements can be made with good reproducibility through particle size management.

In preferable embodiments, the aforementioned particle size-adjusted powder is allowed to adhere to the entire surface (the entire surface of the magnet) of the sintered R-T-B based magnet work having the adhesive agent applied thereto, such that the amount of Ga contained in the particle size-adjusted powder is in a range from 0.10 to 1.0% by mass ratio with respect to the sintered R-T-B based magnet work.

1. Providing a Sintered R-T-B Based Magnet Work

A sintered R-T-B based magnet work, in which to diffuse a Pr—Ga alloy, is provided. While what is known can be used as this sintered R-T-B based magnet work, those having the following composition are preferable.

rare-earth element R: 27.5 to 35.0 mass %

B ((boron), part of which may be replaced with C (carbon)): 0.80 to 0.99 mass %

Ga: 0 to 0.8 mass %, additive element(s) M (at least one selected from the group consisting of Al, Cu, Zr and Nb): 0 to 2 mass %

T (transition metal element, which is mainly Fe and may include Co) and inevitable impurities: balance In the above, the following inequality (1) is satisfied.

$$[T]/55.85>14[B]/10.8 \quad (1)$$

([T] represents a T content in mass %; [B] represents a B content in mass %)

Herein, the rare-earth element R consists essentially of a light rare-earth element RL (which is at least one element selected from among Nd and Pr), but may contain a heavy rare-earth element. In the case where a heavy rare-earth element is to be contained, preferably at least one of Dy and Tb is contained.

Moreover, if the Ga content exceeds 0.8 mass %, magnetization of the main phase may lower due to the increased Ga in the main phase, so that high $B_r$ may not be obtained. More preferably, the Ga content is 0.5 mass % or less.

A sintered R-T-B based magnet work of the above composition is produced by any arbitrary production method that is known. The sintered R-T-B based magnet work may have just been sintered, or have been subjected to cutting or polishing.

2. Providing a Particle Size-Adjusted Powder [Diffusion Agent]

The particle size-adjusted powder is composed of a powder of a Pr—Ga alloy. The powder of Pr—Ga alloy function as a diffusion agent.

In the Pr—Ga alloy, Pr accounts for 65 to 97 mass % of the entire Pr—Ga alloy; 20 mass % or less of Pr is replaceable with Nd; and 30 mass % or less of Pr is replaceable with Dy and/or Tb. Ga accounts for 3 mass % to 35 mass % of the entire Pr—Ga alloy; and 50 mass % or less of Ga is replaceable with Cu. Inevitable impurities may be contained. As used in the present disclosure, that "20 mass % or less of Pr is replaceable with Nd" means that, given a Pr content (mass %) in the Pr—Ga alloy being defined as 100%, it is possible to replace 20% thereof with Nd. For example, if Pr in the Pr—Ga alloy accounts for 65 mass % (i.e., Ga accounts for 35 mass %), Nd is replaceable up to 13 mass %. In other words, Pr may account for 52 mass %, and Nd may account for 13 mass %. The same is also true of Dy, Tb, or Cu. By subjecting a Pr—Ga alloy containing Pr and Ga in the aforementioned ranges to a first heat treatment (described below) for a sintered R-T-B based magnet work whose composition is within the range according to the present disclosure, Ga can be diffused deep into the interior of the magnet through the grain boundaries. The present disclosure is characterized by using a Ga-containing alloy whose main component is Pr. Pr is replaceable with Nd, Dy and/or Tb; however, high $B_r$ and high $H_{cJ}$ will not be obtained if the substituted amount of each exceeds the aforementioned range, because of there being too little Pr. Preferably, Nd content in the Pr—Ga alloy is equal to or less than the inevitable impurity content (i.e., 1 mass % or less). Although 50% or less of Ga is replaceable with Cu, $H_{cJ}$ may possibly lower if the amount of substituted Cu exceeds 50%.

The method of producing the RHM1M2 alloy powder is not particularly limited. It may be provided by a method which makes a thin strip of alloy by a roll quenching technique, and then pulverizes this thin strip of alloy; or it may be produced by a known atomization technique, such as centrifugal atomization, a rotating electrode method, gas atomization, or plasma atomization. The particle size of a Pr—Ga alloy powder may be e.g. 500 μm or less, with the smaller ones being on the order of 10 μm.

According to a study by the inventors, when Nd is used instead of Pr, high $B_r$ and high $H_{cJ}$ are less likely to be obtained than when using Pr. This is presumably because, under the specific composition according to the present disclosure, Pr is easier to be diffused into the grain boundary phase than is Nd. Stated otherwise, Pr is considered to have a higher ability to permeate into the grain boundary phase than is Nd. Since Nd is also likely to permeate into the main phase, it is considered that, when an Nd—Ga alloy is used, some of Ga will also be diffused into the main phase. When a Pr—Ga alloy is used, the amount of Ga to be diffused into the main phase is smaller than in the case where Ga is added to an alloy or to an alloy powder, so that $H_{cJ}$ can be improved without hardly lowering $B_r$.

By performing a heat treatment with a powder of Pr—Ga alloy adhering to the sintered R-T-B based magnet work, Pr and Ga can be allowed to diffuse through the grain boundary, while hardly diffusing into the main phase. Since presence of Pr promotes grain boundary diffusion, Pr and Ga are allowed to diffuse deep into the interior of the magnet. As a result, while reducing the RH content, high $B_r$ and high $H_{cJ}$ can be attained.

[Particle Size Adjustment]

The particle size is set so that, when the powder particles composing the particle size-adjusted powder is placed on the entire surface of the sintered R-T-B based magnet work to form a particle layer, the amount of Ga contained in the particle size-adjusted powder is in a range from 0.10 to 1.0% (preferably 0.7 to 1.5%) by mass ratio with respect to the sintered R-T-B based magnet work. The particle size may be, as described above, determined through experimentation. Preferably, the experimentation for particle size determination is performed in accordance with the actual production method.

As the mass ratio of Ga to be diffused into the sintered R-T-B based magnet work to the sintered R-T-B based magnet work increases from zero, greater $H_{cJ}$ increments are obtained. However, through a separately performed experiment, it was found that, when conditions other than the Ga amount are the same, e.g., the heat treatment condition, $H_{cJ}$ is saturated near a Ga amount of 1.0 mass %; the $H_{cJ}$ increment will not become greater even if the Ga amount is increased from 1.0 mass %. In other words, when an amount of Pr—Ga alloy such that the Ga amount will account for 0.10 to 1.0 mass % of the sintered R-T-B based magnet work is allowed to adhere to the entire surface of the sintered R-T-B based magnet work, an $H_{cJ}$ improvement can be most efficiently attained.

Prescribing the Ga amount so as to fall in the aforementioned range when adhering in approximately one layer (not less than one layer and not more than three layers) to the surface of the sintered R-T-B based magnet work provides an advantage of being able to manage the Ga amount or $H_{cJ}$ improvement through particle size adjustments. Although depending on the Ga amount contained in the particle size-adjusted powder, the optimum particle size is e.g. greater than 38 μm and equal to or less than 500 μm.

Preferably, the particle size-adjusted powder is allowed to adhere to the entire surface of the sintered R-T-B based magnet work having the adhesive agent applied thereto. The reason is that a more efficient coercivity improvement can be attained.

The particle size of the particle size-adjusted powder may be adjusted through screening. If the particle size-adjusted powder to be eliminated through screening accounts for 10 mass % or less, it will not matter very much; thus, screening may be omitted. In other words, preferably 90 mass % or more of the particle size of the particle size-adjusted powder falls within the aforementioned range.

A Pr—Ga alloy powder by itself may have its particle size adjusted, without e.g. granulation. For example, if the shape of the powder particles is isometric or spherical, then the particle size may be adjusted so that the Ga amount in the Pr—Ga alloy powder to adhere is 0.10 to 1.0% by mass ratio with respect to the sintered R-T-B based magnet work, whereby it can be straightforwardly used without granulation.

The Pr—Ga alloy may also be granulated with a binder. By being granulated with a binder, the binder will melt through a post-heating step to be described below, such that powder particles will become united by the melted binder, thus becoming less likely to drop and providing an advantage of easier handling.

As the binder, those which will not adhere or aggregate when dried or when the mixed solvent is removed, such that the particle size-adjusted powder can retain smooth fluidity, are preferable. Examples of binders include PVA (polyvinyl alcohol) and the like. As necessary, an aqueous solvent such as water, or an organic solvent such as NMP (n-methylpyrrolidone) may be used for mixing. The solvent will be removed through evaporation in the granulation process to be described later.

The method of granulation with a binder may be arbitrary, e.g., a tumbling granulation method, a fluid bed granulate method, a vibration granulation method, a dry impact blending method (hybridization), a method which mixes a powder and a binder and disintegrates it after solidification, and so on.

In an embodiment of the present disclosure, presence of a powder (second powder) other than the powder of Pr—Ga alloy on the surface of the sintered R-T-B based magnet work is not necessarily precluded; however, care must be taken so that the second powder will not hinder the Pr—Ga alloy from diffusing into the sintered R-T-B based magnet work. It is desirable that the powder of "Pr—Ga alloy" account for 70% or more by mass ratio in the entire powder that exists on the surface of the sintered R-T-B based magnet work.

By using powders whose particle size is thus adjusted, powder particles composing the particle size-adjusted powder are allowed to uniformly adhere to the entire surface of the sintered R-T-B based magnet work, efficiently without waste. In the method according to the present disclosure, imbalances in the thickness of a coating film, as may occur due to gravity or surface tension in the immersion or spraying under conventional techniques, will not occur.

In order to allow powder particles composing the particle size-adjusted powder to be present more uniformly on the surface of the sintered R-T-B based magnet work, preferably the powder particles are placed in approximately one layer, or specifically, in not less than one layer and not more than three layers, on the surface of the sintered R-T-B based magnet work. When a plurality of kinds of powders are granulated for use, particles of the granulated particle size-adjusted powder are allowed to be present in not less than one layer and not more than three layers. As used herein, "not more than three layers" means that, depending on the thickness of the adhesive agent or the size of each particle, particles may be allowed to adhere up to three layers in parts, rather than these particles adhering continuously in three layers. In order to more accurately manage the adhered amount of the powder of Pr—Ga alloy on the basis of particle size, the thickness of the coating layer is preferably not less than one layer, but less than two layers, of powder particles (i.e., the layer thickness is equal to or greater than the particle size (lowest particle size) but less than twice the particle size (lowest particle size)), i.e., the particle size-adjusted powder will not be mutually bonded by the binder in the particle size-adjusted powder so as to be stacked in two or more layers. The lowest particle size means the smallest particle size (e.g. 38 μm) of each particle when screening has been conducted (e.g., to be greater than 38 μm but equal to or less than 300 μm). As mentioned earlier, if the particle size-adjusted powder to be eliminated through screening accounts for 10 mass % or less, it will not matter very much, and thus screening may be omitted; in that case, too, the thickness of the coating layer is preferably equal to or greater than the lowest particle size (e.g. 38 μm) in the case where screening is to be conducted (i.e., when assuming the particle size-adjusted powder to be eliminated through screening is greater than 10 mass %), and equal to or less than twice the lowest particle size (e.g. 76 μm).

3. Adhesive Agent Application Step

Examples of adhesive agents include PVA (polyvinyl alcohol), PVB (polyvinyl butyral), PVP (polyvinyl pyrrolidone), and the like. In the case where the adhesive agent is an aqueous adhesive agent, the sintered R-T-B based magnet work may be subjected to preliminary heating before the application. The purpose of preliminary heating is to remove excess solvent and control adhesiveness, and to allow the adhesive agent to adhere uniformly. The heating temperature is preferably 60° C. to 100° C. In the case of an organic solvent-type adhesive agent that is highly volatile, this step may be omitted.

The method of applying an adhesive agent onto the surface of the sintered R-T-B based magnet work may be arbitrary. Specific examples of application include spraying, immersion, application by using a dispenser, and so on.

In order to allow the particle size-adjusted powder to adhere in approximately one layer to the surface of the sintered R-T-B based magnet work, the applied amount of the adhesive agent is preferably $1.02\times10^{-5}$ to $5.10\times10^{-5}$ g/mm$^2$.

4. Step of Allowing the Particle Size-Adjusted Powder to Adhere to the Surface of the Sintered R-T-B Based Magnet Work In one preferable implementation, an adhesive agent is applied to the entire surface of the sintered R-T-B based magnet work (entire surface). Rather than to the entire surface of the sintered R-T-B based magnet work, it may be allowed to adhere to a portion thereof. Especially when the sintered R-T-B based magnet work has a thin thickness (e.g., about 2 mm), among surfaces of the sintered R-T-B based magnet work, only the one surface that is the largest in geometric area may have the particle size-adjusted powder adhering thereto, whereby Pr and Ga can be diffused into the entire magnet and improve $H_{cJ}$ in some cases.

With the production method according to the present disclosure, through a single step, the particle size-adjusted powder can be allowed to adhere in not less than one layer and not more than three layers to a plurality of regions of different normal directions within the surface of the sintered R-T-B based magnet work.

Since it is intended in the present invention that the particle size-adjusted powder adhere in approximately one layer (not less than one layer and not more than three layers), the thickness of the adhesive layer is preferably on the order of the lowest particle size of particle size-adjusted powder. Specifically, the thickness of the adhesive layer is preferably not less than 10 μm and not more than 100 μm.

The method of allowing the particle size-adjusted powder to adhere to the sintered R-T-B based magnet work may be arbitrary. Examples of the methods of adhesion include: a method which allows the particle size-adjusted powder to adhere to the sintered R-T-B based magnet work having the adhesive agent applied thereto by using a fluidized-bed coating method which will be described later; a method in which the sintered R-T-B based magnet work having the adhesive agent applied thereto is dipped in a process chamber accommodating the particle size-adjusted powder; a method in which the particle size-adjusted powder is sprinkled over the sintered R-T-B based magnet work having the adhesive agent applied thereto; and so on. At this time, the process chamber accommodating the particle size-adjusted powder may be subjected to vibration, or the particle size-adjusted powder may be allowed to flow, in order to facilitate adhesion of the particle size-adjusted powder to the surface of the sintered R-T-B based magnet work. However, since the particle size-adjusted powder is intended to adhere in approximately one layer according to the present disclosure, it is preferable that adhesion is based substantially solely on the adhesiveness of the adhesive agent. For example, a method where a powder for adhesion is placed in a process chamber together with an impact medium and allowed to adhere to the surface of the sintered R-T-B based magnet work by virtue of an impact, or further where the powder is mutually allowed to bind with an impact force from the impact medium for film growth, is not preferable because not only approximately one layer but also a number of layers will be formed.

As the method of adhesion, for example, a method in which a sintered R-T-B based magnet work having the adhesive agent applied thereto is immersed in a flowing particle size-adjusted powder, i.e., a so-called fluidized-bed coating method (fluidized bed coating process), may be used. Hereinafter, an example of applying a fluidized-bed coating method will be described. A fluidized-bed coating method is a method which has conventionally been broadly conducted in fields of powder coating; a heated object to be coated is immersed in a flowing thermoplastic powder coating, so that the coating is allowed to melt and adhere with the heat on the surface of the object to be coated. In this example, in order to apply the fluidized-bed coating method to a magnet, the aforementioned particle size-adjusted powder is used instead of a thermoplastic powder coating, and the sintered R-T-B based magnet work having the adhesive agent applied thereto is used instead of a heated coating object.

The method for causing the particle size-adjusted powder to flow may be arbitrary. For instance, as one specific example, a method where a chamber having a porous partition in its lower portion will be described. In this example, the particle size-adjusted powder is placed in the chamber, and a gas such as atmospheric air or an inert gas is pressured so as to be injected into the chamber from below the partition, and the particle size-adjusted powder above the partition is allowed to be lifted and flow with the pressure or jet.

By allowing the sintered R-T-B based magnet work having the adhesive agent applied thereto to be immersed in (or placed on, or passed through) a particle size-adjusted powder which is flowing inside the chamber, the particle size-adjusted powder is allowed to adhere to the sintered R-T-B based magnet work. The time for which the sintered R-T-B based magnet work having the adhesive agent applied thereto is immersed may be e.g. on the order of 0.5 to 5.0 seconds. By using the fluidized-bed coating method, the particle size-adjusted powder is allowed to flow (i.e., agitated) within the chamber, whereby relatively large powder particles can be restrained from adhering to the magnet surface in abundance, or conversely, relatively small powder particles can be restrained from adhering to the magnet surface at a distance. As a result, the particle size-adjusted powder can adhere to the sintered R-T-B based magnet work more uniformly.

In one preferable embodiment, a heat treatment (post heat treatment) is performed for causing the particle size-adjusted powder to become fixed to the surface of the sintered R-T-B based magnet work. The heating temperature may be set to 150 to 200° C. If the particle size-adjusted powder is one that has been granulated with a binder, the binder will melt and become fixed, thereby causing the particle size-adjusted powder to become fixed.

5. Diffusing Step of Heating the Sintered R-T-B Based Magnet Work Having the Particle Size-Adjusted Powder Adhering Thereto (Step of Performing a First Heat Treatment)

The sintered R-T-B based magnet work with a powder layer of Pr—Ga alloy of the above composition adhering thereto is subjected to a heat treatment, in a vacuum or an inert gas ambient, at a temperature which is above 600° C. but not higher than 950° C. In the present specification, this heat treatment is referred to as a first heat treatment. Through this, a liquid phase containing Pr and/or Ga occurs from the Pr—Ga alloy, and this liquid phase is diffused from the surface into the interior of the sintered work, through grain boundaries in the sintered R-T-B based magnet work. As a result, Ga as well as Pr is allowed to diffuse deep into the sintered R-T-B based magnet work through the grain boundaries. If the first heat treatment temperature is 600° C. or lower, high $H_{cJ}$ may not be obtained because the amount of liquid phase containing Pr and/or Ga may be too small; if it is above 950° C., $H_{cJ}$ may become lower. Preferably, the sintered R-T-B based magnet work which has undergone the first heat treatment (above 600° C. but not higher than 940° C.) is cooled to 300° C. at a cooling rate of 5° C./minute from the temperature at which the first heat treatment was conducted. This will produce higher $H_{cJ}$. Furthermore preferably, the cooling rate down to 300° C. is equal to or greater than 15° C./minute.

(Step of Performing a Second Heat Treatment)

In a vacuum or an inert gas ambient, the sintered R-T-B based magnet work having undergone the first heat treatment is subjected to a heat treatment at a temperature which is lower than the temperature used in the step of performing the first heat treatment and which is not lower than 450° C. and not higher than 750° C. In the present specification, this heat treatment is referred to as a second heat treatment. By performing the second heat treatment, an R-T-Ga phase occurs in the grain boundary phase, whereby high $H_{cJ}$ can be obtained. If the second heat treatment is at a temperature which is higher than that of the first heat treatment, or if the temperature of the second heat treatment is below 450° C. or above 750° C., the amount of generated R-T-Ga phase will be too small to obtain high $H_{cJ}$.

EXAMPLES

Experimental Example 1

First, by a known method, a sintered R-T-B based magnet work with the following mole fractions was produced: Nd=30.0, B=0.89, Al=0.1, Cu=0.1, Co=1.1, balance=Fe (mass %). By machining this, a sintered R-T-B based magnet work which was sized 4.9 mm thick×7.5 mm wide×40 mm long was obtained.

Next, a particle size-adjusted powder composed of a Pr—Ga alloy was produced. Raw materials of the respective elements were weighed so as to result in mole fractions of Pr=89 and Ga=11, and these raw materials were melted, thereby providing an alloy in a ribbon shape or flake shapes by a single-roll rapid quenching technique (melt spinning technique). By using a mortar, the resultant alloy was pulverized in an argon ambient. The pulverized Pr—Ga alloy powder was classify through screening to result in particle sizes of 106 μm or less. By using PVA (polyvinyl alcohol) as a binder and water as a solvent, a paste which was mixed so that Pr—Ga alloy powder:PVA:water=90:5:5 (mass ratio) was subjected to hot air drying in order to evaporate the solvent, and pulverized in an Ar ambient. The pulverized granulate powder was subjected to screening, thus being classified into the following four: particle sizes of 38 μm or less, greater than 38 μm but 300 μm or less, greater than 300 μm but 500 μm or less, greater than 106 μm but 212 μm or less.

Next, an adhesive agent was applied to the sintered R-T-B based magnet work. After the sintered R-T-B based magnet work was heated to 60° C. on a hot plate, the adhesive agent was applied to the entire surface of the sintered R-T-B based magnet work by spraying. As the adhesive agent, PVP (polyvinyl pyrrolidone) was used.

Next, the particle size-adjusted powder was allowed to adhere to the sintered R-T-B based magnet work having the adhesive agent applied thereto. The particle size-adjusted powder was spread out in a process chamber, and after the sintered R-T-B based magnet work having the adhesive agent applied thereto was cooled to room temperature, the particle size-adjusted powder was allowed to adhere, in a manner of dusting, over the entire surface of the sintered R-T-B based magnet work in the process chamber.

Figure 4:
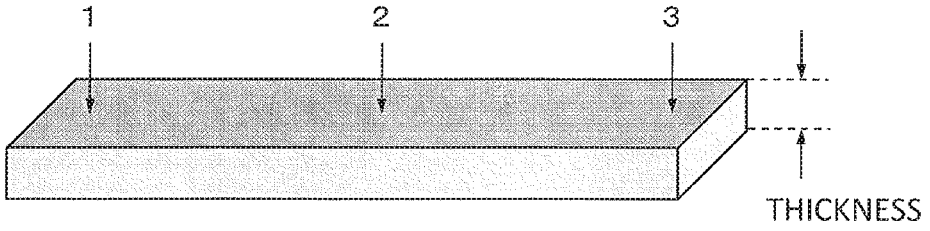
FIG. 4 A perspective view showing positions at which the layer thickness of a particle size-adjusted powder on the sintered R-T-B based magnet work 100 was measured.

The sintered R-T-B based magnet work having the particle size-adjusted powder adhering thereto was observed with a stereomicroscope, which revealed that the particle size-adjusted powder had adhered uniformly in one layer to the surface of the sintered R-T-B based magnet work, while leaving substantially no spaces. It was also confirmed that the particle size-adjusted powder satisfied: (1) a plurality of particles being in contact with the surface of the adhesive layer 20; (2) a plurality of particles adhering to the surface of the sintered R-T-B based magnet work 100 via nothing but the adhesive layer 20; and (3) other particles sticking to one or more particles among the plurality of particles not via any adhesive material, in accordance with the present disclosure. Moreover, with respect to samples whose particle size-adjusted powder had a particle size which was greater than 106 μm but 212 μm or less, the thickness of the sintered R-T-B based magnet work having the particle size-adjusted powder adhering thereto, in the 4.9 mm direction, was measured. For each sintered R-T-B based magnet work, measurements were taken at the three places, i.e., positions 1, 2 and 3 shown in FIG. 4 (N=25 each). The values of increase from the sintered R-T-B based magnet work before the particle size-adjusted powder adhered thereto (i.e., values ascribable to increases on both faces) are shown in Table 1. The values were almost identical among the three places, with hardly any variation in thickness depending on the measurement point.

TABLE 1

| position of | increase in thickness after adhesion (mm/2 faces) | | |
|---|---|---|---|
| measurement | max | min | average |
| 1 | 0.382 | 0.280 | 0.328 |
| 2 | 0.395 | 0.302 | 0.340 |
| 3 | 0.377 | 0.279 | 0.318 |

Furthermore, what was obtained by subtracting the mass of the sintered R-T-B based magnet work before the particle size-adjusted powder adhered thereto from the mass of the sintered R-T-B based magnet work having the particle size-adjusted powder adhering thereto was defined as a mass of the particle size-adjusted powder; from this value, a Ga amount (mass %) that had adhered, relative to the magnet mass, was calculated.

The calculated values of adhered amounts of Ga are shown in Table 2. From the results of Table 2, the particle size-adjusted powder having a particle size which was greater than 38 μm but 300 μm or less had its adhered amount of Ga being in the range from 0.10 to 1.0% by mass ratio, thus allowing for most efficient adhesion of the Pr—Ga alloy. Any particle size-adjusted powder having a particle size of 38 μm or less had too small a particle size to result in an adequate adhered amount of Ga with a mere adhesion of approximately one layer. On the other hand, any particle size-adjusted powder which was greater than 300 up to 500 μm had too large an adhered amount, thus wasting the Pr—Ga alloy.

From the above experiment, it was indicated that, through controlling the particle size of the particle size-adjusted powder, a Ga-containing powder can be allowed to adhere to the magnet surface efficiently and uniformly.

TABLE 2

| particle size of particle size-adjusted | adhered amount of Ga (mass %) | | |
|---|---|---|---|
| powder (μm) | max | min | average |
| 38 μm or less | 0.12 | 0.05 | 0.08 |
| 38-300 μm | 0.62 | 0.41 | 0.55 |
| 300-500 μm | 1.30 | 1.69 | 1.48 |

Experimental Example 2

To each powder having a particle size which was greater than 106 μm but 212 μm or less used in Experimental Example 1, 10 mass % of a powder which was 38 μm or less, or 10 mass % of a powder which was greater than 300 μm, was mixed; by a method similar to that of Experimental Example 1, the particle size-adjusted powder was allowed to adhere to the surface of the sintered R-T-B based magnet work. An adhered amount of Ga was calculated from the amount of particle size-adjusted powder that had adhered, which indicated that the adhered amount of Ga was in the range from 0.10 to 1.0% by mass ratio for both cases. This indicates that mixing 10 mass % of a powder deviating from the desired particle size would not have any influence.

Experimental Example 3

With each composition shown in Table 3, a sintered R-T-B based magnet work which was sized 7.4 mm×7.4 mm×7.4 mm was provided. By using the Pr—Ga alloy as shown in Table 4, PVA (polyvinyl alcohol) as a binder, and water as a solvent, a particle size-adjusted powder having a particle size which was greater than 106 μm but 212 μm or less was provided by the same method as in Experimental Example 1. According to combinations shown in Table 5, the particle size-adjusted powder having been produced was allowed to adhere to the same sintered R-T-B based magnet work as that in Experimental Example 1. Furthermore, these were subjected to heat treatments at heat treatment temperatures shown in Table 5. By using a surface grinding machine, the sintered R-T-B based magnet work after the heat treatments was subjected to cutting to remove 0.2 mm off the entire surface of each sample; a 7.0 mm×7.0 mm×7.0 mm cube was cut out; and magnetic characteristics thereof were measured. The measured values of magnetic characteristics are shown in Table 5. For every such sintered R-T-B based magnet work, high magnetic characteristics of $B_r \geq 1.30$ T and $H_{CJ} \geq 1490$ kA/m were obtained; thus, it was confirmed that $H_{CJ}$ had been improved in each by 160 kA/m or more, while hardly lowering $B_r$.

TABLE 3

| | composition of sintered R-T-B based magnet work (mass %) | | | | | | | | | | | |
|---|---|---|---|---|---|---|---|---|---|---|---|---|
| No. | Nd | Pr | Dy | Tb | B | Cu | Al | Ga | Zr | Nb | Co | Fe |
| A | 30.0 | 0.0 | 0.0 | 0.0 | 0.89 | 0.1 | 0.1 | 0.0 | 0.0 | 0.0 | 1.0 | 67.1 |
| B | 24.0 | 7.0 | 0.0 | 0.0 | 0.88 | 0.1 | 0.1 | 0.2 | 0.0 | 0.0 | 1.0 | 67.1 |
| C | 24.0 | 7.0 | 0.0 | 0.0 | 0.86 | 0.1 | 0.1 | 0.2 | 0.0 | 0.0 | 1.0 | 67.1 |
| D | 24.0 | 7.0 | 0.0 | 0.0 | 0.90 | 0.1 | 0.2 | 0.3 | 0.0 | 0.0 | 1.0 | 66.5 |
| E | 17.0 | 13.0 | 0.0 | 0.0 | 0.87 | 0.1 | 0.2 | 0.0 | 0.0 | 0.0 | 1.0 | 67.8 |
| F | 24.0 | 9.0 | 0.5 | 0.0 | 0.88 | 0.2 | 0.2 | 0.8 | 0.0 | 0.0 | 1.0 | 63.5 |
| G | 24.0 | 7.0 | 0.0 | 1.0 | 0.88 | 0.2 | 0.1 | 0.3 | 0.2 | 0.0 | 1.0 | 65.4 |
| H | 24.0 | 7.0 | 0.0 | 1.0 | 0.88 | 0.2 | 0.1 | 0.3 | 0.0 | 0.5 | 1.0 | 65.1 |

TABLE 4

| | composition of Pr—Ga alloy (mass %) | | |
|---|---|---|---|
| No. | Nd | Pr | Ga |
| a | 0 | 89 | 11 |
| b | 0 | 65 | 35 |
| c | 0 | 80 | 20 |
| d | 0 | 97 | 3 |
| e | 9 | 80 | 11 |
| f | 7 | 82 | 11 |
| g | 10 | 65 | 15 |

TABLE 5

| No. | producing conditions: sintered R-T-B based magnet work | Pr—Ga alloy | first heat treatment | second heat treatment | $B_r$(T) | $H_{CJ}$ (kA/m) |
|---|---|---|---|---|---|---|
| 1 | A | a | 900° C. | 500° C. | 1.39 | 1610 |
| 2 | B | a | 850° C. | 500° C. | 1.36 | 1730 |
| 3 | C | b | 800° C. | 500° C. | 1.35 | 1580 |
| 4 | C | c | 800° C. | 500° C. | 1.35 | 1640 |
| 5 | C | a | 800° C. | 500° C. | 1.35 | 1740 |
| 6 | C | d | 800° C. | 500° C. | 1.35 | 1700 |
| 8 | B | e | 850° C. | 500° C. | 1.36 | 1700 |
| 9 | B | f | 850° C. | 500° C. | 1.36 | 1680 |
| 10 | B | g | 850° C. | 500° C. | 1.36 | 1570 |
| 11 | D | a | 900° C. | 500° C. | 1.36 | 1670 |
| 12 | E | a | 900° C. | 500° C. | 1.36 | 1810 |
| 13 | F | a | 900° C. | 500° C. | 1.30 | 1700 |
| 14 | G | a | 900° C. | 500° C. | 1.35 | 1930 |
| 15 | H | a | 900° C. | 500° C. | 1.35 | 1950 |

Experimental Example 4

A sintered R-T-B based magnet work of No. A of Experimental Example 3 was produced by a method similar to that of Experimental Example 3. By machining this, a sintered R-T-B based magnet work sized 4.9 mm thick×7.5 mm wide×40 mm long was obtained.

Next, a $Pr_{89}Ga_{11}$ alloy (mass %) was produced through atomization, thereby providing a particle size-adjusted powder. The particle size-adjusted powder was a spherical powder. The particle size-adjusted powder was subjected to screening, thus being classified into the following two: particle sizes of 300 μm or less and 38 to 300 μm.

Next, an adhesive agent was applied to the sintered R-T-B based magnet work by a method similar to that of Experimental Example 1.

Figure 5:
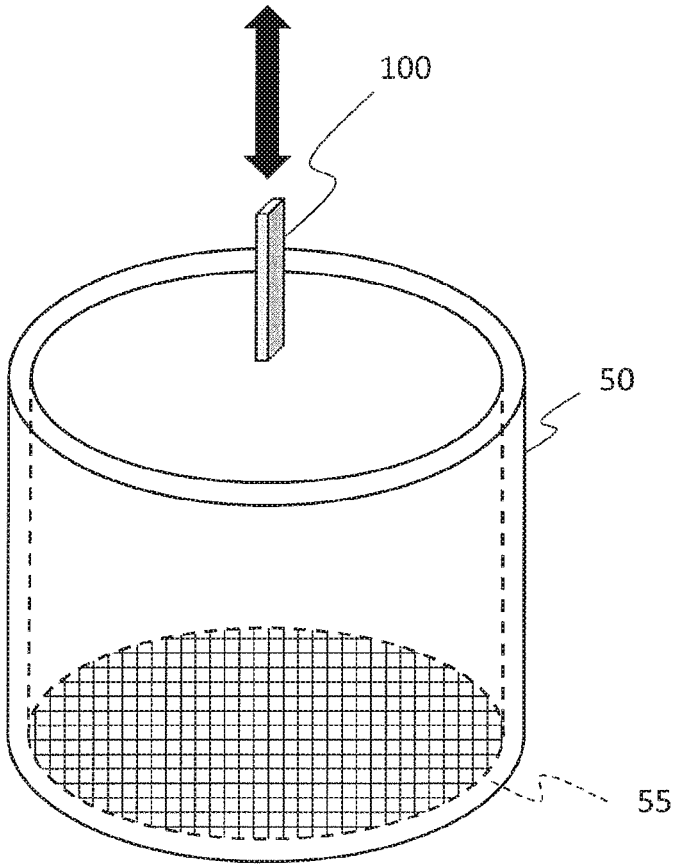
FIG. 5 A diagram schematically showing a process chamber in which a fluidized-bed coating method is performed.

Next, the particle size-adjusted powder was allowed to adhere to the sintered R-T-B based magnet work having the adhesive agent applied thereto. As the method of adhesion, a fluidized-bed coating method was used. A process chamber 50 in which the fluidized-bed coating method was carried out is schematically shown in FIG. 5. This process chamber has a generally cylindrical shape with an open top, with a porous partition 55 at the bottom. The process chamber 50 used in the experiment had an inner diameter of 78 mm and a height of 200 mm, while the partition 55 had an average pore diameter of 15 μm and a porosity of 40%. The particle size-adjusted powder was placed inside the process chamber 50, to a depth of about 50 mm. From below the porous partition 55, atmospheric air was injected into the process chamber 50 at a flow rate of 2 liters/min, thereby allowing the particle size-adjusted powder to flow. The flowing powder came to a height of about 70 mm. The sintered R-T-B based magnet work 100 having the adhesive agent adhering thereto was fixed with a clamp jig not shown, and was immersed in the flowing particle size-adjusted powder ($Pr_{89}Ga_{11}$ alloy powder) for 1 second and then retrieved, thus allowing the particle size-adjusted powder to adhere to the sintered R-T-B based magnet work 100. Note that the jig fixed the magnet at two points of contact on both sides of a 4.9 mm×40 mm face of the magnet, and was immersed in such a manner that the 4.9 mm×7.5 mm faces with the narrowest geometric area were situated as top and bottom faces.

Moreover, with respect to samples whose particle size-adjusted powder had a particle size of 38 to 300 μm, the thickness of the sintered R-T-B based magnet work having the particle size-adjusted powder adhering thereto, in the 4.9 mm direction, was measured. The positions of measurement were identical to those in Experimental Example 1; measurements were taken at the three places, i.e., positions 1, 2 and 3 shown in FIG. 4 (N=25 each). The values of increase from the sintered R-T-B based magnet work before the particle size-adjusted powder adhered thereto (i.e., values ascribable to increases on both faces) are shown in Table 6. The values were almost identical among the three places, with hardly any variation in thickness depending on the measurement point. Moreover, samples whose particle size-adjusted powder had a particle size of 300 μm or less were also similarly measured, which indicated that the values were almost identical among the three places, with hardly any variation in thickness depending on the measurement point. This is because, since the fluidized-bed coating method was used as the method of adhesion, the particle size-adjusted powder uniformly adhered to the sintered R-T-B based magnet work, rather than the finer powder adhering first to the sintered R-T-B based magnet work.

For samples whose particle size-adjusted powder had a particle size of 38 to 300 μm or that of 300 μm or less, the sintered R-T-B based magnet work having the particle size-adjusted powder adhering thereto was observed with a stereomicroscope, which revealed that, similarly to the 38 to 300 μm sample in Experimental Example 1, the particle size-adjusted powder had adhered uniformly in one layer to the surface of the sintered R-T-B based magnet work, and that the particles 30 composing the particle size-adjusted powder had densely adhered so as to form one layer (particle layer). It was also confirmed that the samples whose particle size-adjusted powder had a particle size of 38 to 300 μm or that of 300 μm or less satisfied: (1) a plurality of particles being in contact with the surface of the adhesive layer 20; (2) a plurality of particles adhering to the surface of the sintered R-T-B based magnet work 100 via nothing but the adhesive layer 20; and (3) other particles sticking to one or more particles among the plurality of particles not via any adhesive material, in accordance with the present disclosure.

TABLE 6

| position of measurement | increase in thickness after adhesion (μm/2 faces): max | min | average |
|---|---|---|---|
| 1 | 588 | 536 | 568 |
| 2 | 574 | 514 | 546 |
| 3 | 580 | 522 | 552 |

Experimental Example 5

A sintered R-T-B based magnet work was produced by a method similar to that of Experimental Example 4. By machining this, a sintered R-T-B based magnet work sized 4.9 mm thick×7.5 mm wide×40 mm long was obtained. Furthermore, similarly to Experimental Example 4, particle size-adjusted powders ($Pr_{89}Ga_{11}$) were provided. Furthermore, these were subjected to a heat treatment according to the heat treatment temperatures and times shown in Table 7 by a method similar to that of Experimental Example 4, thus allowing the elements in the diffusion source to diffuse into the sintered R-T-B based magnet work. Note that the particle size of the particle size-adjusted powder was adjusted so as to result in the adhered amounts of Ga shown in Table 7. From a central portion of the sintered R-T-B based magnet work after the heat treatment, a cube which was 4.5 mm thick×7.0 mm wide×7.0 mm long was cut out, and its $H_{cJ}$ was measured. $\Delta H_{cJ}$ values, as obtained by subtracting the $H_{cJ}$ of the sintered R-T-B based magnet work from the measured coercivity, are shown in Table 7. As indicated by Table 7, it was confirmed that coercivity had greatly improved for adhered amounts of RH being in the range of 0.1 to 1.0.

TABLE 7

| composition of Pr—Ga alloy (mass %) | adhered amount of Ga (mass %) | heat treatment temperature (° C.) | time (Hr) | ⊿HcJ (kA/m) |
|---|---|---|---|---|
| $Pr_{89}Ga_{11}$ | 0.05 | 900 | 2 | 120 |
| $Pr_{89}Ga_{11}$ | 0.10 | 900 | 2 | 330 |
| $Pr_{89}Ga_{11}$ | 0.80 | 900 | 2 | 390 |
| $Pr_{89}Ga_{11}$ | 1.00 | 900 | 2 | 410 |

INDUSTRIAL APPLICABILITY

Embodiments of the present disclosure can improve $H_{cJ}$ of a sintered R-T-B based magnet work with less of a Pr—Ga alloy, and therefore may be used in producing a rare-earth sintered magnet for which a high HcJ is expected.

REFERENCE SIGNS LIST

20 adhesive layer
30 powder particles composing particle size-adjusted powder
100 sintered R-T-B based magnet work
100*a* upper face of sintered R-T-B based magnet work
100*b* side face of sintered R-T-B based magnet work
100*c* side face of sintered R-T-B based magnet work

The invention claimed is:

1. A method for producing a sintered R-T-B based magnet, comprising:

a step of providing a sintered R-T-B based magnet, where R is a rare-earth element; and T is Fe, or Fe and Co;

a step of providing a particle size-adjusted powder that consists essentially of a powder of a Pr—Ga alloy, Pr accounts for 65 to 97 mass % of the entire Pr—Ga alloy; 20 mass % or less of Pr is replaceable with Nd; 30 mass % or less of Pr is replaceable with Dy and/or Tb; Ga accounts for 3 mass % to 35 mass % of the entire Pr—Ga alloy; and 50 mass % or less of Ga is replaceable with Cu; inevitable impurities may be contained;

an application step of applying an adhesive agent to an application area of a surface of the sintered R-T-B based magnet by spraying, by immersion, or by using a dispenser to form an adhesive layer;

an adhesion step of allowing the particle size-adjusted powder to adhere to the application area of the surface of the sintered R-T-B based magnet having the adhesive layer, wherein a fluidized-bed coating method is conducted to allow the sintered R-T-B based magnet having the adhesive layer to pass through the powder of the Pr—Ga alloy which is flowing inside a chamber; and a heat treatment step of heating the sintered R-T-B based magnet having the particle size-adjusted powder adhering thereto at a temperature which is equal to or lower than a sintering temperature of the sintered R-T-B based magnet, wherein the adhesion step is a step of allowing the particle size-adjusted powder to adhere in not less than one layer and not more than three layers to the surface of the sintered R-T-B based magnet, such that the amount of Ga contained in the particle size-adjusted powder adhering to the surface of the sintered R-T-B based magnet is in a range from 0.10 to 1.0% with respect to the sintered R-T-B based magnet by mass ratio.

2. The method for producing a sintered R-T-B based magnet of claim 1, wherein, the sintered R-T-B based magnet comprises R: 27.5 to 35.0 mass %, R is at least one rare-earth element which always includes Nd, B: 0.80 to 0.99 mass %, Ga: 0 to 0.8 mass %, M: 0 to 2 mass %, where M is at least one of Cu, Al, Nb, and Zr, and a balance T, where T is Fe, or Fe and Co, and inevitable impurities, the sintered R-T-B based magnet having a composition satisfying the inequality:

$$[T]/55.85>14[B]/10.8,$$

where [T] represents a T content in mass %, and [B] represents a B content in mass %.

3. The method for producing a sintered R-T-B based magnet of claim 1, wherein an Nd content in the Pr—Ga alloy is equal to or less than an inevitable impurity content.

4. The method for producing a sintered R-T-B based magnet of claim 1, wherein the particle size-adjusted powder is a particle size-adjusted powder which has been granulated with a binder.

5. The method for producing a sintered R-T-B based magnet of claim 1, wherein the adhesion step is a step of allowing the particle size-adjusted powder to adhere to a plurality of regions of different normal directions on the surface of the sintered R-T-B based magnet.

6. The method for producing a sintered R-T-B based magnet of claim 1, wherein the heat treatment step comprises: performing a first heat treatment at a temperature which is above 600° C. but not higher than 950° C., in a vacuum or an inert ambient gas; and a step of subjecting the sintered R-T-B based magnet having undergone the first heat treatment to a second heat treatment at a temperature which is lower than the temperature used in the step of performing the first heat treatment and which is not lower than 450° C. and not higher than 750° C., in a vacuum or an inert gas ambient.

7. A method for producing a sintered R-T-B based magnet, comprising:

a step of providing a sintered R-T-B based magnet, where R is a rare-earth element; and T is Fe, or Fe and Co;

a step of providing a diffusion source powder that is composed of a powder of a Pr—Ga alloy, Pr accounts for 65 to 97 mass % of the entire Pr—Ga alloy; 20 mass % or less of Pr is replaceable with Nd; 30 mass % or less of Pr is replaceable with Dy and/or Tb; Ga accounts for 3 mass % to 35 mass % of the entire Pr—Ga alloy; and 50 mass % or less of Ga is replaceable with Cu; inevitable impurities may be contained;

an application step of applying an adhesive agent to an application area of a surface of the sintered R-T-B based magnet by spraying, by immersion, or by using a dispenser to form an adhesive layer;

an adhesion step of allowing the diffusion source powder to adhere to the application area of the surface of the sintered R-T-B based magnet having the adhesive layer, wherein a fluidized-bed coating method is conducted to allow the sintered R-T-B based magnet having the adhesive layer to pass through the powder of the Pr—Ga alloy which is flowing inside a chamber; and a diffusing step of heating the sintered R-T-B based magnet having the diffusion source powder adhering thereto at a temperature which is equal to or lower than a sintering temperature of the sintered R-T-B based magnet to allow the Ga contained in the diffusion source powder to diffuse from the surface into the interior of the sintered R-T-B based magnet, wherein in the adhesion step, the diffusion source powder adhering to the application area comprises: (1) a plurality of particles being in contact with a surface of the adhesive layer; (2) a plurality of particles adhering to the surface of the sintered R-T-B based magnet via nothing but the adhesive layer; and (3) other particles sticking to one or more particles among the plurality of particles not via any adhesive material.

8. The method for producing a sintered R-T-B based magnet of claim 7, wherein, in the adhesion step, the diffusion source powder is allowed to adhere to the application area so that the amount of Ga contained in the diffusion source powder is in a range from 0.1 to 1.0% with respect to the sintered R-T-B based magnet by mass ratio.

9. The method for producing a sintered R-T-B based magnet of claim 1, wherein the thickness of the adhesive layer is not less than 10 μm and not more than 100 μm.

10. The method for producing a sintered R-T-B based magnet of claim 9, wherein a particle size of 90 mass % or more of particles in the particle size-adjusted powder is greater than 38 μm and equal to or less than 500 μm.

11. The method for producing a sintered R-T-B based magnet of claim 10, wherein the particle size is equal to or less than 300 μm.

* * * * *